US008099976B2

(12) United States Patent
Zhang et al.

(10) Patent No.: US 8,099,976 B2
(45) Date of Patent: Jan. 24, 2012

(54) OIL-RETURNING DEVICE AND ACCUMULATOR

(75) Inventors: Zhijun Zhang, Zhejiang Province (CN); Feng Chen, Zhejiang Province (CN); Yong Pan, Zhejiang Province (CN); Guojiang Shao, Zhejiang Province (CN)

(73) Assignee: Zhejiang Sanhua Climate and Appliance Controls Group Co., Ltd, Chengguan Town (CN)

( * ) Notice: Subject to any disclaimer, the term of this patent is extended or adjusted under 35 U.S.C. 154(b) by 608 days.

(21) Appl. No.: 12/235,946

(22) Filed: Sep. 23, 2008

(65) Prior Publication Data

US 2009/0084130 A1 Apr. 2, 2009

(30) Foreign Application Priority Data

Sep. 29, 2007 (CN) ..... 2007 1 0071480

(51) Int. Cl.
*F25B 43/02* (2006.01)

(52) U.S. Cl. ..... 62/470

(58) Field of Classification Search ..... 62/470, 62/468, 474, 475, 503; 55/387, 389
See application file for complete search history.

(56) References Cited

U.S. PATENT DOCUMENTS 4,270,934 A * 6/1981 Widdowson et al. ..... 96/152
4,295,806 A * 10/1981 Tanaka et al. ..... 418/97
4,457,843 A * 7/1984 Cullen et al. ..... 210/282
4,474,035 A * 10/1984 Amin et al. ..... 62/503
4,800,737 A * 1/1989 Smith et al. ..... 62/503
4,827,725 A * 5/1989 Morse ..... 62/503
4,994,185 A * 2/1991 Cullen et al. ..... 210/282
5,022,902 A * 6/1991 Juhl et al. ..... 96/108
5,177,982 A * 1/1993 Plemens ..... 62/503
5,184,479 A * 2/1993 Koberstein et al. ..... 62/503
5,746,065 A * 5/1998 Patel et al. ..... 62/503
5,778,697 A * 7/1998 Wantuck ..... 62/503
5,970,738 A * 10/1999 DeNolf et al. ..... 62/474
6,244,055 B1 * 6/2001 Hanson et al. ..... 62/85
6,298,687 B1 * 10/2001 Dienhart et al. ..... 62/513
(Continued)

FOREIGN PATENT DOCUMENTS

CN 2804738 8/2006
JP 2001012827 1/2001
JP 2002350013 12/2002
JP 2003121031 4/2003

*Primary Examiner* — Mohammad Ali
(74) *Attorney, Agent, or Firm* — Wolf, Greenfield & Sacks, P.C.

(57) ABSTRACT

The present invention provides an oil-returning device and a accumulator, the oil-returning device including an outlet pipe and a filtering component, the outlet pipe having an bent arc portion which is provided with a positioning hole, the filtering component including a filtering screen and a filtering screen base with an oil-returning orifice, and being fixedly installed in the positioning hole, wherein an effective cross section area Sn of an inner space of the outlet pipe at a position where the filtering component is installed is in a range of 50%~90% of an original effective cross section area S0 of the inner space of the untreated outlet pipe at a position where the filtering component is to be installed. The accumulator includes a hermetically sealed container, a inlet pipe and the oil-returning device, wherein in the case of a given diameter of the outlet pipe and a diameter of the oil-returning orifice, appropriate oil-returning capacity will be attained by setting the effective cross section area of the inner space at the oil-returning orifice of the outlet pipe, and thus the production has significant versatility and can meet the requirements of various refrigeration systems.

11 Claims, 3 Drawing Sheets

U.S. PATENT DOCUMENTS 6,389,842 B1 * 5/2002 Telesz et al. ..... 62/503
6,438,972 B1 * 8/2002 Pickett et al. ..... 62/85
6,481,241 B1 * 11/2002 Fisk et al. ..... 62/503
6,494,057 B1 * 12/2002 Schuster et al. ..... 62/475
6,536,230 B2 * 3/2003 Coyle et al. ..... 62/503
6,568,204 B2 * 5/2003 Fisk et al. ..... 62/503
6,792,773 B2 * 9/2004 Kuhn et al. ..... 62/503
2002/0139136 A1 * 10/2002 Noble, III ..... 62/473

* cited by examiner

OIL-RETURNING DEVICE AND ACCUMULATOR

TECHNICAL FIELD OF THE INVENTION

The present invention relates to the components of the refrigeration system, specifically to an oil-returning device and an accumulator comprising the same, which particularly adapt to the refrigeration system using refrigerating oil, such as the circuits of air conditioners and refrigerators.

BACKGROUND OF THE INVENTION

The accumulator with oil-returning device, which is important component of the refrigeration system, is mainly used in the medium-sized or large-sized air conditioners or other refrigeration systems, and is mounted in front of the compressor and serves to receive, split, filtrate, circle oil, store refrigerant, thus plays a very important role in ensuring the normal operation of the system.

The accumulator includes a hermetically sealed container for storing temporarily refrigerant circulating in the refrigeration system circuit, an inlet pipe for introducing the refrigerant into the hermetically sealed container, an outlet pipe for discharging the refrigerant from the hermetically sealed container, and a filtering component with an oil-returning orifice and fixedly installed in the outlet pipe. The common accumulator further includes supporting board and gas-guiding component and so on. Generally, the refrigerant fluid in gas-liquid mixture state is introduced from the inlet pipe into the hermetically sealed container, wherein the gaseous refrigerant exists in a upper part of the hermetically sealed container due to smaller density, that is, the gaseous refrigerant is introduced into an inlet of the U-shaped outlet pipe and then enters into the compressor by flowing through the U-shaped outlet pipe under certain pressure difference. However the liquid mixture of the liquid refrigerant and the liquid refrigerating oil sinks at the bottom of the accumulator, such that the separation of gas from liquid in the mixture is achieved, and the liquid refrigerant fluid can be prevented from entering into the compressor and causes it damaged due to shock of the liquid refrigerant fluid.

At the bent arc portion of the U-shaped outlet pipe of the accumulator is arranged a filtering component including a filtering screen base with an oil-returning orifice and a filtering screen. Since there is a certain pressure difference between the inlet and outlet of the accumulator, when the gaseous refrigerant fluid flows through the bent arc portion of the U-shaped outlet pipe, negative pressure occurs at the oil-returning orifice of the filtering component, such that an appropriate quantity of the refrigerating oil can be introduced in the compressor through the outlet pipe, which enables the compressor being well lubricated and prevents the movable components of the compressor from being damaged due to poor lubrication.

The oil-returning capacity is an important property of the accumulator. If oil returning is performed properly, the following premises should be meet: (1) an appropriate pressure difference between the inlet pipe and the outlet pipe should be present, which is predetermined by the air conditioner factory during design stage; (2) appropriate-sized oil-returning orifice should be provided, as is generally determined in the air conditioner factory by experiment, and (3) in the case that the above two conditions are satisfied, it is necessary to have appropriate pressure difference at the oil-returning orifice of the filtering component, in order to ensure the refrigerating oil being drawn into the compressor. The pressure difference at the oil-returning orifice of the filtering component is generated by the following two factors, one of which is the gravity of the liquid refrigerant fluid and the liquid refrigerating oil per se depending on the quantity of the refrigerant and the refrigerating oil filled in the system and is difficult to adjust, the other one of which is the pressure difference resulting from a certain negative pressure at the filtering component generated when the gaseous refrigerant fluid flows in the outlet pipe. Thus, if it is needed to adjust the oil-returning capacity to provide the compressor with the best lubrication, it can be achieved only by adjusting the latter factor.

Chinese patent 200610036696.9 (publication number CN1900635A) discloses a technical solution, wherein a small oil-returning orifice with a certain diameter is directly formed in the outlet pipe, and a filtering component is welded in the small oil-returning orifice to form an oil-returning and filtering passage. The technical solution mainly has the following two disadvantages: (A) if the diameter of the oil-returning orifice and the diameter of the U-shaped outlet pipe remain unchanged (the diameter of the oil-returning orifice and the diameter of the U-shaped outlet pipe are very important parameters for the system, and in most cases are mainly designed by the air conditioner factory and will not be changed easily), in case that pressure difference of the system remains unchanged, it cannot be achieved to adjust the oil-returning capacity, and thus the product has poor versatility and is difficult to meet the requirements of various refrigeration system; and (B) since the oil-returning orifice is directly produced in the U-shaped outlet pipe, there may occur burrs which cannot be removed completely through checking or mechanical removal method, and thus dropped burr will enter into the compressor and cause the block in the compressor and the failure of the system.

Compared with the technical solution of Chinese patent 200610036696.9, Chinese Utility Model patent ZL200520102761.4 (publication number CN2804738Y) discloses an improved solution, in which a filtering component provided with an oil-returning orifice are soldered to the U-shaped outlet pipe, instead of the oil-returning orifice directly formed in the U-shaped outlet pipe. However, when the diameter of the oil-returning orifice and the diameter of the U-shaped outlet pipe are determined, the oil-returning capacity also cannot be adjusted and thus cannot meet the requirements of various refrigeration systems, in case that pressure difference of the system remains unchanged.

Therefore, there exists a need for an oil-returning device and an accumulator comprising the same capable of achieving appropriate oil-returning capacity in case that diameter of the oil-returning orifice and the diameter of the outlet pipe are given.

SUMMARY OF THE INVENTION

The object of the present invention is to provide an oil-returning device and a accumulator using the same, which obviate the defect in prior art that it is difficult to achieve the desirable oil-returning capacity in case that the diameter of the outlet pipe and the diameter of the oil-returning orifice are given.

In one aspect of the present invention, an oil-returning device is provided, which comprises an outlet pipe and a filtering component, the outlet pipe having a bent arc portion which is provided with a positioning hole, the filtering component comprising a filtering screen and a filtering screen base with an oil-returning orifice, and being fixedly installed in the positioning hole; wherein an effective cross section area Sn of an inner space of the outlet pipe at a position where the filtering component is installed is in a range of 50%~90% of an original effective cross section area S0 of the inner space of the untreated outlet pipe at a position where the filtering component is to be installed.

Preferably, the effective cross section area Sn is in a range of 60%~80% of the original effective cross section area S0.

Preferably, the positioning hole of the bent arc portion of the outlet pipe is provided with a depressed plane.

Preferably, the cross section of the bent arc portion of the outlet pipe presents a non-circular shape.

Preferably, the outlet pipe is formed with a recess at an outside wall of the bent arc portion.

Preferably, the filtering component is inserted in the positioning hole of the outlet pipe by a depth M deeper than the depth of the positioning hole.

In another aspect of the present invention, an accumulator is provided, which comprises a hermetically sealed container, a inlet pipe and an oil-returning device, the oil-returning device comprising an outlet pipe and a filtering component, the outlet pipe having an bent arc portion which is provided with a positioning hole, the filtering component comprising a filtering screen and a filtering screen base with an oil-returning orifice, and being fixedly installed in the positioning hole; wherein an effective cross section area Sn of an inner space of the outlet pipe at a position where the filtering component is installed is in a range of 50%~90% of an original effective cross section area S0 of the inner space of the untreated outlet pipe at a position where the filtering component is to be installed.

Preferably, the effective cross section area Sn is in a range of 60%~80% of the original effective cross section area S0.

Preferably, the hermetically sealed container is comprised of an upper cover, a lower cover and a cylindrical housing with two openings at two ends thereof, with the two ends of the cylindrical housing being connected with the upper cover and lower cover respectively.

Preferably, the hermetically sealed container is formed by welding the upper cover, the lower cover and the cylindrical housing.

Preferably, the hermetically sealed container is comprised of two semi-cylindrical housings each with an opening at one end thereof, the two semi-cylindrical housings being connected with each other.

Preferably, the hermetically sealed container is formed by welding the two semi-cylindrical housings together.

The present invention achieves the following advantageous effect that in the oil-returning device and the accumulator comprising the same, under the condition of the outlet pipe and given diameter of the oil-returning orifice having given diameter, appropriate oil-returning capacity will be attained by setting the effective cross section area of the inner space of a portion of the outlet pipe where the oil-returning orifice is arranged, and thus the oil-returning device and the accumulator have significant versatility and can meet the requirements of various refrigeration systems.

DETAILED DESCRIPTION OF THE PREFERRED EMBODIMENTS

Figure 1A:
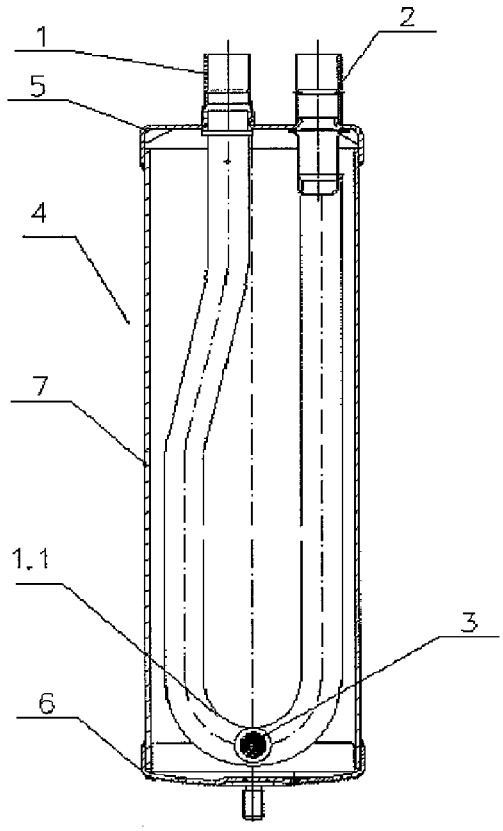
FIG. 1A schematically shows a longitudinal sectional view of a first embodiment of an accumulator according to the present invention.
Figure 1B:
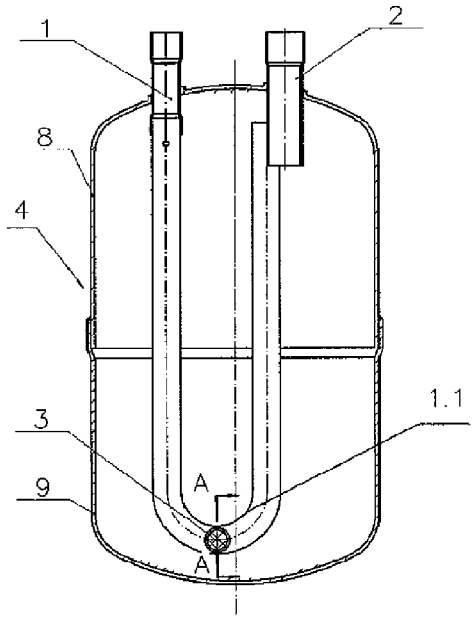
FIG. 1B schematically shows a longitudinal sectional view of a second embodiment of an accumulator according to the present invention.

As shown in FIG. 1A and FIG. 1B, structures of accumulators of a first embodiment and a second embodiment according to the present invention are respectively illustrated, and each of the accumulators comprises a hermetically sealed container 4 for storing temporarily refrigerant circulating in the refrigeration system circuit, a inlet pipe 2 for introducing the above described refrigerant into the hermetically sealed container, an outlet pipe 1 for discharging the above described refrigerant from the hermetically sealed container and having a bent arc portion 1.1 provided with a positioning hole 1.2, and a filtering component 3 fixedly installed in the positioning hole 1.2, wherein the filtering component 3 comprises a filtering screen base 3.1 with an oil-returning orifice 3.3 and a filtering screen 3.2. The difference between the two accumulators shown in FIG. 1A and in FIG. 1B lies in that the hermetically sealed container 4 of the accumulator in FIG. 1A is comprised of an upper end cover 5, a lower end cover 6 and a cylindrical housing 7 with two openings at both ends thereof, with the two ends of the cylindrical housing 7 are connected with the upper end cover 5 and the lower end cover 6 by means of welding, while the hermetically sealed container 4 of the accumulator in FIG. 1B is comprised of two semi-cylindrical housings 8, 9 welded together, each of which having an opening at one end thereof. Of course, although it is preferable to connect the upper cover 5, the lower cover 6 and cylindrical housing 7 with two openings by welding as illustrated in FIG. 1A, other suitable connecting methods can also be employed as long as sufficient sealing effect can be achieved, as is also similarly applied to the accumulator in FIG. 1B.

Figure 2:
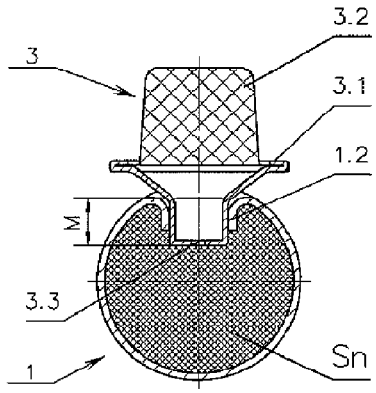
FIG. 2 schematically shows a cross sectional view of a first embodiment of the accumulator according to the present invention, wherein the filtering component has been fitted to the outlet pipe.

FIG. 2 shows a first embodiment of the accumulator according to the present invention, wherein the filtering component has been fitted to the outlet pipe. In this embodiment, the outlet pipe 1 is treated such that the filtering component 3 is inserted in the positioning hole 1.2 of the outlet pipe 1 by a depth M deeper than the depth of the positioning hole 1.2. The depth M can be altered so as to change the effective cross section Sn of the inner space of the outlet pipe 1 at the position where the filtering component is installed.

Figure 3:
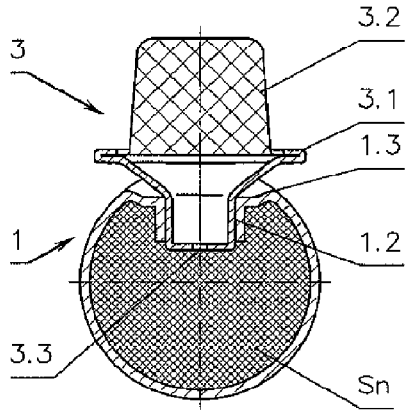
FIG. 3 schematically shows a cross sectional view of a second embodiment of the accumulator according to the present invention, wherein the filtering component has been fitted to the outlet pipe.

FIG. 3 shows a second embodiment of the accumulator according to the present invention, wherein the filtering component has been fitted to the outlet pipe. In this embodiment, the outlet pipe 1 is treated such that the positioning hole 1.2 arranged on the outlet pipe 1 is provided with a depressed plane 1.3, such that the effective cross section Sn of the inner space of the outlet pipe 1 at a position where the filtering component 3 is installed is decreased.

Figure 4:
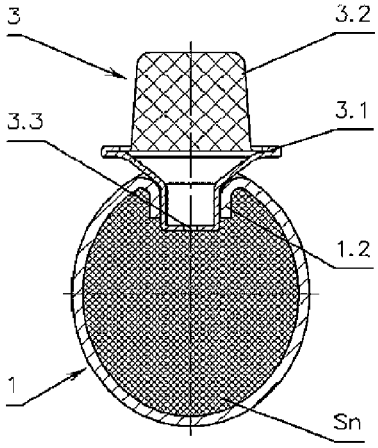
FIG. 4 schematically shows a cross sectional view of a third embodiment of the accumulator according to the present invention, wherein the filtering component has been fitted to the outlet pipe.

FIG. 4 shows a third embodiment of the accumulator according to the present invention, wherein the filtering component has been fitted to the outlet pipe. In this embodiment, the outlet pipe 1 is treated such that the bent arc portion 1.1 of the outlet pipe 1 presents a non-circular cross section due to the exerting of an external force, that is, the cross section thereof is changed from circular section to non-circular section under the action of external force. Because the cross section area of a circle is larger than that of an ellipse or other non-circular shape under a given perimeter, the effective cross section Sn of the inner space of the outlet pipe 1 at a position where the filtering component 3 is installed is decreased.

Figure 5:
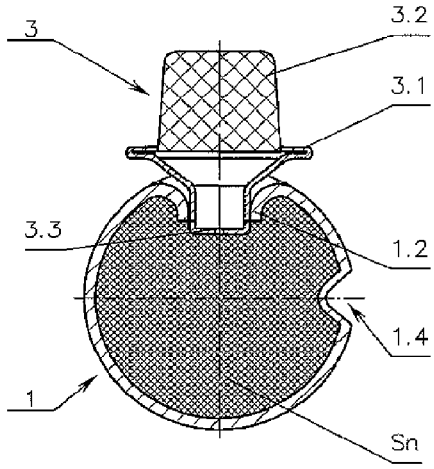
FIG. 5 schematically shows a cross sectional view of a fourth embodiment of the accumulator according to the present invention, wherein the filtering component has been fitted to the outlet pipe.

FIG. 5 shows a fourth embodiment of the accumulator according to the present invention, wherein the filtering component has been fitted to the outlet pipe. In this embodiment, the outlet pipe 1 is treated such that the outlet pipe is formed with a recess 1.4 at outside wall of the bent arc portion, such that the effective cross section Sn of the inner space of the whole outlet pipe 1 at a position where the filtering component is installed is decreased.

Figure 6:
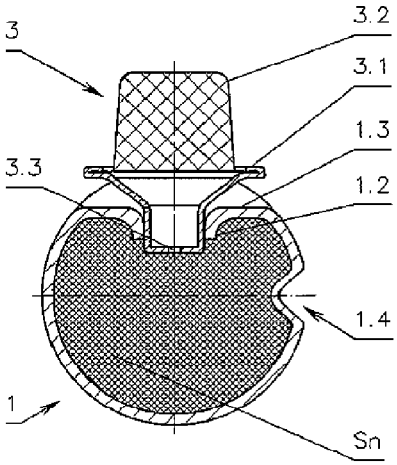
FIG. 6 schematically shows a cross sectional view of a fifth embodiment of the accumulator according to the present invention, wherein the filtering component has been fitted to the outlet pipe.

FIG. 6 shows a fifth embodiment of the accumulator according to the present invention, wherein the filtering component has been fitted to the outlet pipe. In this embodiment, the outlet pipe 1 is treated such that the outlet pipe is formed with a recess 1.4 at outside wall of the bent arc portion, and the positioning hole 1.2 of the outlet pipe 1 is provided with a depressed plane 1.3, such that the effective cross section Sn of the inner space of the outlet pipe 1 at a position where the filtering component 3 is installed is decreased. As can be seen from above, the structure of the outlet pipe of the fifth embodiment is a combination of those of the second and the fourth embodiments.

Figure 7:
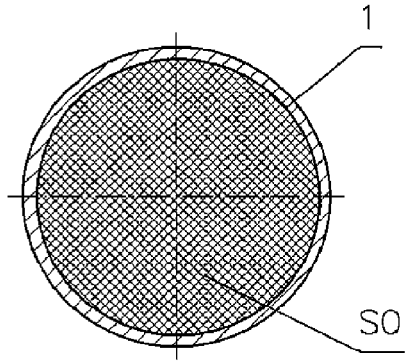
FIG. 7 schematically shows an original effective cross sectional area S0 of the inner space, at the position where the filtering component is to be installed, of the outlet pipe prior to being treated.

FIG. 7 shows an original effective cross sectional area S0 of the inner space, at the position where the filtering component is to be installed, of the outlet pipe prior to being treated.

It shall be understood that, the filtering component in each of the above described embodiment is welded in the positioning hole in order to ensure sufficient sealing effect. However, the present invention is not limited hereto, other methods can be employed to install the filtering component in the positioning hole, as long as sufficient sealing effect can be ensured.

Figure 8:
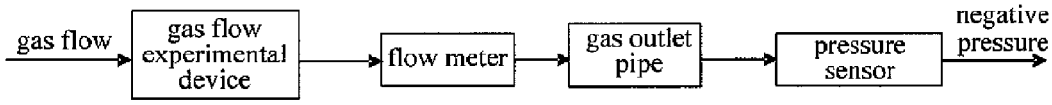
FIG. 8 schematically shows a flowchart of a negative pressure test conducted on the outlet pipe of the accumulator.

For purpose of determining how the oil-returning capacity of the accumulator will alter as the effective cross section Sn changes under a given outside diameter D of the outlet pipe and the diameter d of the oil-returning orifice, tests have been conducted to the accumulator according to the method and the process shown in FIG. 8, and some experiment data from the test are presented in the following tables:

| Gas flow (cubic feet/hr) | Negative pressure value generated at the filtering component (inch(es) of water) | | | | |
|---|---|---|---|---|---|
| | Sn/S0 = 50% | Sn/S0 = 60% | Sn/S0 = 70% | Sn/S0 = 80% | Sn/S0 = 90% |
| D = ϕ16 mm; d = ϕ0.74 mm | | | | | |
| 600 | 1.00 | 0.93 | 0.68 | 0.56 | 0.40 |
| 700 | 1.30 | 1.12 | 0.85 | 0.7 | 0.51 |
| 800 | 1.60 | 1.36 | 1.05 | 0.84 | 0.63 |
| 900 | beyond the measurement range | beyond the measurement range | 1.25 | 1.06 | 0.76 |
| 1000 | beyond the measurement range | beyond the measurement range | 1.48 | 1.24 | 0.89 |

-continued

| Gas flow (cubic feet/hr) | Negative pressure value generated at the filtering component (inch(es) of water) | | | | |
|---|---|---|---|---|---|
| | Sn/S0 = 50% | Sn/S0 = 60% | Sn/S0 = 70% | Sn/S0 = 80% | Sn/S0 = 90% |
| D = ϕ19 mm; d = ϕ1.4 mm | | | | | |
| 600 | 0.53 | 0.43 | 0.26 | 0.21 | 0.05 |
| 700 | 0.68 | 0.57 | 0.39 | 0.32 | 0.06 |
| 800 | 0.84 | 0.75 | 0.53 | 0.48 | 0.07 |
| 900 | 0.99 | 0.91 | 0.7 | 0.62 | 0.08 |
| 1000 | 1.2 | 1.12 | 0.94 | 0.83 | 0.09 |
| D = ϕ22.2 mm; d = ϕ1.4 mm | | | | | |
| 600 | 0.36 | 0.29 | 0.17 | 0.14 | 0.03 |
| 700 | 0.46 | 0.41 | 0.27 | 0.20 | 0.04 |
| 800 | 0.56 | 0.52 | 0.34 | 0.26 | 0.05 |
| 900 | 0.68 | 0.63 | 0.44 | 0.33 | 0.07 |
| 1000 | 0.82 | 0.74 | 0.53 | 0.47 | 0.09 |
| D = ϕ28.6 mm; d = ϕ1.52 mm | | | | | |
| 600 | 0.42 | 0.34 | 0.20 | 0.12 | 0.01 |
| 700 | 0.52 | 0.47 | 0.29 | 0.17 | 0.02 |
| 800 | 0.64 | 0.59 | 0.37 | 0.23 | 0.03 |
| 900 | 0.78 | 0.72 | 0.48 | 0.30 | 0.03 |
| 1000 | 0.93 | 0.84 | 0.71 | 0.37 | 0.03 |

Remarks:
The measurement range of the pressure sensor is 0~1.60 inches of water.

As can be seen from above, in the case where the diameter d of the oil-returning orifice and the outside diameter D of the outlet pipe are given, the negative pressure value decreases as Sn/S0 increases. However, when Sn/S0<50%, obvious noise arises and the fluid pressure drop of the system increases. Base on the results of the test, it is appropriate that Sn/S0 is in a range of 50%~90%, which Sn/S0 can be adjusted in the range of 50%~90% to enable the system to achieve the desirable oil-returning capacity depending on the requirement for the oil-returning capacity of different systems. It is preferable that Sn/S0 is in a range of 60%~80%, such that the more desirable oil-returning capacity can be achieved.

While this invention has been described with reference to exemplary embodiments thereof, it will be obvious to those skilled in the art that, the various modifications and variations may be made to the present invention without departing from the spirit and scope of the present invention. Thus, the present invention intends to cover all the modifications and variations fall within the scope as defined in the appended claims and their equivalents.

What is claimed is:

1. An oil-returning device, comprising an outlet pipe and a filtering component, the outlet pipe having a bent arc portion which is provided with a positioning hole, the filtering component comprising a filtering screen and a filtering screen base with an oil-returning orifice, and being fixedly installed in the positioning hole; wherein an effective cross section area of an inner space of the outlet pipe at a position where the filtering component is installed is in a range of 50%-90% of an original effective cross section area of the inner space of the untreated outlet pipe at a position where the filtering component is to be installed, and the outlet pipe is formed with a recess at an outside wall of the bent arc portion.

2. The oil-returning device according to claim 1, wherein the effective cross section area is in a range of 60%-80% of the original effective cross section area.

3. The oil-returning device according to claim 1, wherein the positioning hole of the bent arc portion of the outlet pipe is provided with a depressed plane.

4. The oil-returning device according to claim 1, wherein the cross section of the bent arc portion of the outlet pipe presents a non-circular shape.

5. The oil-returning device according to claim 1, wherein the filtering component is inserted in the positioning hole of the outlet pipe by a depth deeper than the depth of the positioning hole.

6. An accumulator, comprising a hermetically sealed container, a inlet pipe and an oil-returning device, the oil-returning device comprising an outlet pipe and a filtering component, the outlet pipe having a bent arc portion which is provided with a positioning hole, the filtering component comprising a filtering screen and a filtering screen base with an oil-returning orifice, and being fixedly installed in the positioning hole; wherein an effective cross section area of an inner space of the outlet pipe at a position where the filtering component is installed is in a range of 50%-90% of an original effective cross section area of the inner space of the untreated outlet pipe at a position where the filtering component is to be installed, and the outlet pipe is formed with a recess at an outside wall of the bent arc portion.

7. The accumulator according to claim 6, wherein the effective cross section area is in a range of 60%-80% of the original effective cross section area.

8. The accumulator according to claim 6, wherein the hermetically sealed container is comprised of an upper cover, a lower cover and a cylindrical housing with two openings at two ends thereof, with the two ends of the cylindrical housing being connected with the upper cover and the lower cover respectively.

9. The accumulator according to claim 8, wherein the hermetically sealed container is formed by welding the upper cover, the lower cover and the cylindrical housing.

10. The accumulator according to claim 6, wherein the hermetically sealed container is comprised of two semi-cylindrical housings each with an opening at one end thereof, the two semi-cylindrical housings being connected with each other.

11. The accumulator according to claim 10, wherein the hermetically sealed container is formed by welding the two semi-cylindrical housings together.

* * * * *